US007574863B2

(12) United States Patent
Yatsuzuka et al.

(10) Patent No.: US 7,574,863 B2
(45) Date of Patent: Aug. 18, 2009

(54) FLUID PUMP AND RANKINE CYCLE SYSTEM

(75) Inventors: Shinichi Yatsuzuka, Chiryu (JP); Shuzo Oda, Kariya (JP); Katsuya Komaki, Kariya (JP); Yasumasa Hagiwara, Kariya (JP)

(73) Assignee: Denso Corporation, Kariya (JP)

( * ) Notice: Subject to any disclaimer, the term of this patent is extended or adjusted under 35 U.S.C. 154(b) by 399 days.

(21) Appl. No.: 11/507,832

(22) Filed: Aug. 22, 2006

(65) Prior Publication Data

US 2007/0044473 A1 Mar. 1, 2007

(30) Foreign Application Priority Data

Sep. 1, 2005 (JP) ..... 2005-253566

(51) Int. Cl.
*F01K 1/00* (2006.01)

(52) U.S. Cl. ..... 60/670

(58) Field of Classification Search ..... 60/645, 60/670

See application file for complete search history.

(56) References Cited

U.S. PATENT DOCUMENTS 4,249,378 A * 2/1981 Benson ..... 60/525
5,192,022 A * 3/1993 Swenson ..... 237/2 B
5,419,135 A * 5/1995 Wiggs ..... 60/641.15
6,422,836 B1 * 7/2002 Krueger et al. ..... 417/418
6,948,316 B2 9/2005 Minemi et al.
2005/0193735 A1 * 9/2005 Yatsuzuka et al. ..... 60/670

FOREIGN PATENT DOCUMENTS

JP 2003-97222 4/2003
JP 2003-161101 6/2003
JP 2005-248889 9/2005

* cited by examiner

*Primary Examiner*—Hoang M Nguyen
(74) *Attorney, Agent, or Firm*—Harness, Dickey & Pierce, PLC

(57) ABSTRACT

A fluid pump enabling circulation of a working fluid in a Rankine cycle system etc. without utilizing electrical energy and able to be realized at a low cost, provided with a water pump for pumping up working fluid (water) from a steam condenser of the Rankine cycle system and feeding it to a boiler, a fluid vessel, a heater heating and vaporizing working fluid in the vessel, and a cooler cooling and liquefying the steam obtained by vaporization at the heater. Further, the fluid vessel is provided with a vibrator storing expansion energy by the expansion pressure of the steam heated by the heater. When the cooler causes the steam to condense and the pressure falls, the energy stored in the vibrator is used to feed working fluid to the heater 12 where the working fluid is then heated.

3 Claims, 9 Drawing Sheets

HIGH PRESSURE CONDITION

LOW PRESSURE CONDITION

FLUID PUMP AND RANKINE CYCLE SYSTEM

BACKGROUND OF THE INVENTION

1. Field of the Invention

The present invention relates to a fluid pump suitable for circulating a working fluid in a Rankine cycle system etc. and to a Rankine cycle system using that fluid pump.

2. Description of the Related Art

In the past, to utilize water or another working fluid to generate mechanical energy in a Rankine cycle system, the working fluid is heated using a boiler or superheater to generate high pressure steam and that generated high pressure steam is used to drive a turbine or piston for generating energy. Further, the steam utilized for driving these is liquefied by recovery at a steam condenser etc. and the liquefied working fluid is again fed to a boiler utilizing a fluid pump so as to recirculate the working fluid inside the system (for example, see Japanese Patent Publication (A) No. 2003-97222 and Japanese Patent Publication (A) No. 2003-161101).

However, in a conventional Rankine cycle system, as the fluid pump for circulating the working fluid, usually an electrically driven electrical pump is used. For this reason, a conventional Rankine cycle system is required to be provided with a drive circuit for driving this electrical pump, a power circuit for supplying power, etc. The configuration of the equipment therefore becomes complicated and an increase in cost is invited.

SUMMARY OF THE INVENTION

An object of the present invention is to provide a fluid pump able to recirculate a working fluid in a Rankine cycle system etc. without utilizing electrical energy and able to be realized at a low cost and to provide a Rankine cycle system utilizing such a fluid pump.

To achieve the above object, according to a first aspect of the invention, there is provided a fluid pump provided with a fluid vessel in which a fluid is sealed in a flowable manner, a heater heating and vaporizing the fluid in this fluid vessel, and a cooler arranged below this heater and cooling and liquefying the steam vaporized in the fluid vessel.

Further, when the heating by the heater generates steam in the fluid vessel and that expansion pressure causes the liquid in the fluid vessel to flow, that fluid pressure causes a discharge side one-way valve to open and the liquid in the fluid vessel to be discharged to the outside. Further, when the cooler is used to cool and liquefy the steam, the pressure in the fluid vessel falls and the liquid in the fluid vessel flows in the opposite direction to the time of vaporization. Further, when the liquid flows in this way, the fluid pressure (in this case, negative pressure) causes a suction side one-way valve to open and the liquid to be sucked in from the outside to the fluid vessel.

Therefore, the fluid pump of the first aspect of the invention functions as a pump for discharging and sucking in a liquid by just heating and cooling the fluid in the fluid vessel. There is no need, like in an electrically driven fluid pump (that is, an electrical pump), to supply electrical energy through a power circuit or drive circuit. For this reason, if utilizing this fluid pump as a pump for circulating the working fluid in a Rankine cycle system, a Rankine cycle system can be realized at a low cost.

Further, operating this fluid pump requires heating and cooling of the fluid in the fluid vessel, but if utilizing this fluid pump in a Rankine cycle system, the heat utilized for heating the working fluid in the Rankine cycle system, the cooling water for cooling the working fluid, etc. may be utilized to heat and cool the fluid in the fluid vessel, so the running costs required for operating the fluid pump can be reduced.

Still further, in the fluid pump of the first aspect of the invention, the fluid passage from the fluid vessel at the opposite side to the heater of the cooler to each one-way valve is provided with an energy storing means for storing part of the expansion energy generated at the time of expansion of the steam and compressing the steam and liquid by the stored energy at the time of steam liquefies.

For this reason, according to this fluid pump, after the expansion pressure of the steam is used to discharge liquid from the discharge side one-way valve to the outside, the steam is cooled, and fluid is sucked in from the outside, the energy stored in the energy storing means can be used to quickly send fluid into the heater and quickly start heating of the fluid by the heater. That is, according to the present invention, the energy storing means can be used to promote movement of fluid in the fluid vessel and raise the operating efficiency of the fluid pump.

Note that in this fluid pump, the energy storing means, as shown in the second aspect of the invention, can be provided with a partition separating the fluid passage from the outer space and able to displace to the outer space side by pressure of the fluid in the fluid passage and store expansion energy by the displacement of the partition or, as shown in the third aspect of the invention, can be provided in the fluid passage with a partition able to displace to the discharge direction of the fluid by pressure of the fluid in the passage and store expansion energy by the displacement of this partition.

Further, as the partition, a piston, bellows, diaphragm, etc. may be utilized. As the means for using displacement of this partition to actually store the expansion energy, various types of mechanical springs, a gas spring, a flywheel storing displacement of the partition as rotary force, etc. may be utilized.

Next, when actually realizing this fluid pump, as shown in the fourth aspect of the invention, as the fluid vessel, one formed into a substantially U-shaped pipe shape with the bent part positioned at the bottommost part is used. The heater and cooler may be arranged at one straight pipe part of the U-shape of the fluid vessel, while the discharge side one-way valve and suction side one-way valve may be arranged at the discharge side and suction side fluid passages communicated with the other straight pipe part of the U-shape of this fluid vessel.

Further, according to this, compared with the case of configuring the fluid vessel by a straight pipe etc., the fluid vessel can be made smaller. Next, the fluid pump of the fifth aspect of the invention is provided with a fluid vessel, a heater, a cooler arranged below the heater, a discharge side fluid passage for discharging liquid in the fluid vessel to the outside, and a suction side fluid passage for sucking fluid into the fluid vessel from the outside.

Further, the pipe connecting the fluid vessel and the discharge side fluid passage and suction side fluid passage is provided with a piston in a movable manner. This piston is provided with an energy storing means storing part of the expansion energy received by the piston at the time of expansion of the steam, then compressing the steam and liquid by the stored energy when the steam liquefies.

Further, the piston is provided with a first passage communicating the fluid vessel and the discharge side fluid passage when the piston moves to the fluid vessel and a second passage communicating the fluid vessel and suction side fluid passage when the piston moves to the opposite side from the fluid vessel.

For this reason, the fluid pump of the fifth aspect of the invention realizes the functions of the fluid pumps of the first aspect of the invention to the fourth aspect of the invention as discharge side one-way valves and suction side one-way valves by movement of the piston in the pipe and the first passage and second passage changed in communication state along with that movement. By just providing a single piston instead of two one-way valves, it is possible to discharge and suck in liquid in the same way as the fluid pumps of the first aspect of the invention to the fourth aspect of the invention.

Further, the piston also functions as a partition receiving the expansion pressure in the fluid vessel and transferring part of that energy to the energy storing means, so the energy storing means may be comprised of just the above-mentioned spring, gas spring, or flywheel.

Accordingly, the fluid pump of the fifth aspect of the invention can realize functions similar to the fluid pumps of the first aspect of the invention to the fourth aspect of the invention by a simpler configuration and can lower the cost of the fluid pump of the present invention.

Note that when actually realizing the fluid pump of the fifth aspect of the invention, as shown in the sixth aspect of the invention, it is possible to use, as the fluid vessel, one formed into a substantially U-shaped pipe shape with the bent part positioned at the bottommost part and to arrange the heater and cooler at one of the straight pipe parts of the U-shape of this fluid vessel. Further, in this case, the piston should be provided in the pipe connecting the other straight pipe part of the U-shape of the fluid vessel and the discharge side fluid passage and suction side fluid passage.

That is, according to this, like with the fluid pump of the fourth aspect of the invention, compared with the case of forming the fluid vessel by a straight pipe etc., the fluid vessel can be made smaller. Next, in the fluid pumps of the above-mentioned first aspect of the invention to the sixth aspect of the invention, to more reliably make the fluid in the fluid vessel vibrate and discharge and suck in the liquid continuously for a long period, as shown in the seventh aspect of the invention, steam or another gas is kept present in the heating space formed by the heater of the fluid vessel at least during operation of the fluid pump.

That is, for example, if the fluid vessel is filled with too much liquid and the cooling after heating the working fluid results in the elimination of gas (steam or another gas) in the fluid vessel, the expansion/contraction of the working fluid due to the heating/cooling will no longer proceed smoothly and the working fluid will stop moving (vibrating) in the fluid vessel in some cases.

However, as with the seventh aspect of the invention, if configuring the fluid pump so that steam or other gas is kept present in the heating space formed by the heater of the fluid vessel at least during operation of the fluid pump, the steam or other gas in this heating space will cause a cyclic vibratory force to act on the fluid in the fluid vessel, the working fluid in the fluid vessel will continuously vibrate, and liquid will be able to be continuously discharged and sucked in.

Note that to keep vibratory use gas present in the heating space of the fluid vessel in this way, it is sufficient to seal a gas inert with respect to the working fluid in the fluid vessel, but the heater operates during operation of the fluid pump, so if sealing a liquid in the fluid vessel so that part of the steam generated by the heating by the heater remains in the heating space at all times, it is not necessary to seal a separate vibratory use gas into the fluid vessel.

On the other hand, a fluid pump of an eighth aspect of the invention is provided with a ring-shaped fluid vessel in which a fluid is sealed in a flowable manner, a heater heating and vaporizing the fluid in the fluid vessel, and a cooler cooling and liquefying the steam heated and vaporized by this heater, wherein the cooler is arranged above the heater.

For this reason, the steam generated in the vessel by the operation of the heater expands once in the heater, then moves to the cooler side at the top in the fluid vessel and is cooled and liquefied by this cooler. Therefore, inside the fluid vessel of this fluid pump, the fluid is circulated by the heating/cooling of the fluid, and the internal pressure cyclically fluctuates in synchronization with the circulation of the fluid.

Further, the fluid pump of the eighth aspect of the invention is provided with a discharge side one-way valve and suction side one-way valve, so when the fluid circulates in the fluid vessel, these one-way valves alternately open and liquid is alternately discharged and sucked in.

Therefore, according to the fluid pump of the eighth aspect of the invention, effects similar to the fluid pumps of the above-mentioned first aspect of the invention to the seventh aspect of the invention may be obtained. That is, according to this fluid pump, there is no need, like in electrical pump, to supply electrical energy through a power circuit or drive circuit. For this reason, if utilizing this fluid pump as a pump for circulating the working fluid in a Rankine cycle system, a Rankine cycle system can be realized at a low cost and the running costs can be reduced.

Further, the fluid pump of the eighth aspect of the invention is provided in the fluid passage from the ring-shaped fluid vessel to the two one-way valves with an energy storing means for storing part of the expansion energy generated at the time of expansion of the steam and using that stored energy to compress the steam and liquid when the steam later liquefies.

For this reason, according to this fluid pump, after the expansion pressure of the steam is used to discharge liquid from the discharge side one-way valve to the outside, the steam is cooled, and fluid is sucked in from the outside, the energy stored in the energy storing means can be used to quickly send fluid into the heater and quickly start heating of the fluid by the heater. That is, according to the fluid pump of the eighth aspect of the invention, in the same way as the ones of the above-mentioned other aspects of the invention, the energy storing means can be used to promote heating/cooling of the fluid in the fluid vessel and raise the operating efficiency of the fluid pump.

Note that in this fluid pump, the energy storing means, as described in the ninth aspect of the invention, can be provided with a partition separating the fluid passage from the outer space and able to displace to the outer space side by pressure of the fluid in the fluid passage and configured to store expansion energy by the displacement of the partition. Further, in this case, as the partition, the above-mentioned piston, bellows, diaphragm, etc. may be utilized. As the means for actually storing the expansion energy by the displacement of the partition, the above-mentioned spring, gas spring, flywheel, etc. may be utilized.

Next, a fluid pump of a 10th aspect of the invention is provided with a ring-shaped fluid vessel, a heater, a cooler arranged above the heater, a discharge side fluid passage for discharging liquid in the fluid vessel to the outside, and a suction side fluid passage for sucking liquid into the fluid vessel from the outside.

Further, the pipe connecting the fluid vessel and the discharge side fluid passage and suction side fluid passage is provided with a piston in a movable manner. This piston is provided with an energy storing means storing part of the expansion energy received by the piston at the time of expansion of the steam, then compressing the steam and liquid by the stored energy when the steam liquefies.

Further, the piston is provided with a first passage communicating the fluid vessel and the discharge side fluid passage when the piston moves to the fluid vessel and a second passage communicating the fluid vessel and suction side fluid passage when the piston moves to the opposite side from the fluid vessel.

For this reason, the fluid pump of the 10th aspect of the invention can realize the functions of the fluid pumps of the eighth aspect of the invention and the ninth aspect of the invention as discharge side one-way valves and suction side one-way valves by movement of the piston in the pipe and the first passage and second passage changed in communication state along with that movement. By just providing a single piston instead of two one-way valves, it is possible to discharge and suck in liquid in the same way as the fluid pumps of the eighth aspect of the invention and the ninth aspect of the invention.

Further, the piston also functions as a partition receiving the expansion pressure inside the fluid vessel and transferring part of that energy to the energy storing means, so the energy storing means may be comprised by just the above-mentioned spring or gas spring or flywheel.

Accordingly, the fluid pump of the 10th aspect of the invention can realize functions similar to the fluid pumps of the eighth aspect of the invention and the ninth aspect of the invention by a simpler configuration and can reduce the cost of the fluid pump of the present invention.

Note that to extend the heat exchange time of the heater or cooler and the fluid in the fluid pumps of the eighth aspect of the invention to the 10th aspect of the invention and thereby improve the operating efficiencies of the fluid pumps, as in the 11th aspect of the invention, it is preferable to provide a flow rate control means for cyclically changing the flow rate of the fluid circulating through the fluid vessel. As this flow rate control means, it is possible to utilize a solenoid valve, a throttle valve, etc.

Next, the 12th aspect of the invention relates to a Rankine cycle system heating a working fluid to generate high pressure steam, utilizing the generated high pressure steam to generate mechanical energy, and recovering and liquefying the steam utilized for generation of the mechanical energy so as to recirculate the working fluid.

Further, this Rankine cycle system is provided with a fluid pump as set forth in any of the first aspect of the invention to the 11th aspect of the invention as a pump for recovering the liquefied working fluid from said Rankine cycle system and resupplying it to said Rankine cycle system.

Therefore, the Rankine cycle system of the present invention can be realized at a lower cost than a conventional Rankine cycle system utilizing an electrical pump to circulate the working fluid. Further, the running costs can also be reduced.

BRIEF DESCRIPTION OF THE DRAWINGS

The present invention may be more fully understood from the description of the preferred embodiments of the invention set forth below, together with the accompanying drawings, in which.

DESCRIPTION OF THE PREFERRED EMBODIMENTS

Below, embodiments of the present invention will be explained with reference to the drawings.

First Embodiment

Figure 1:
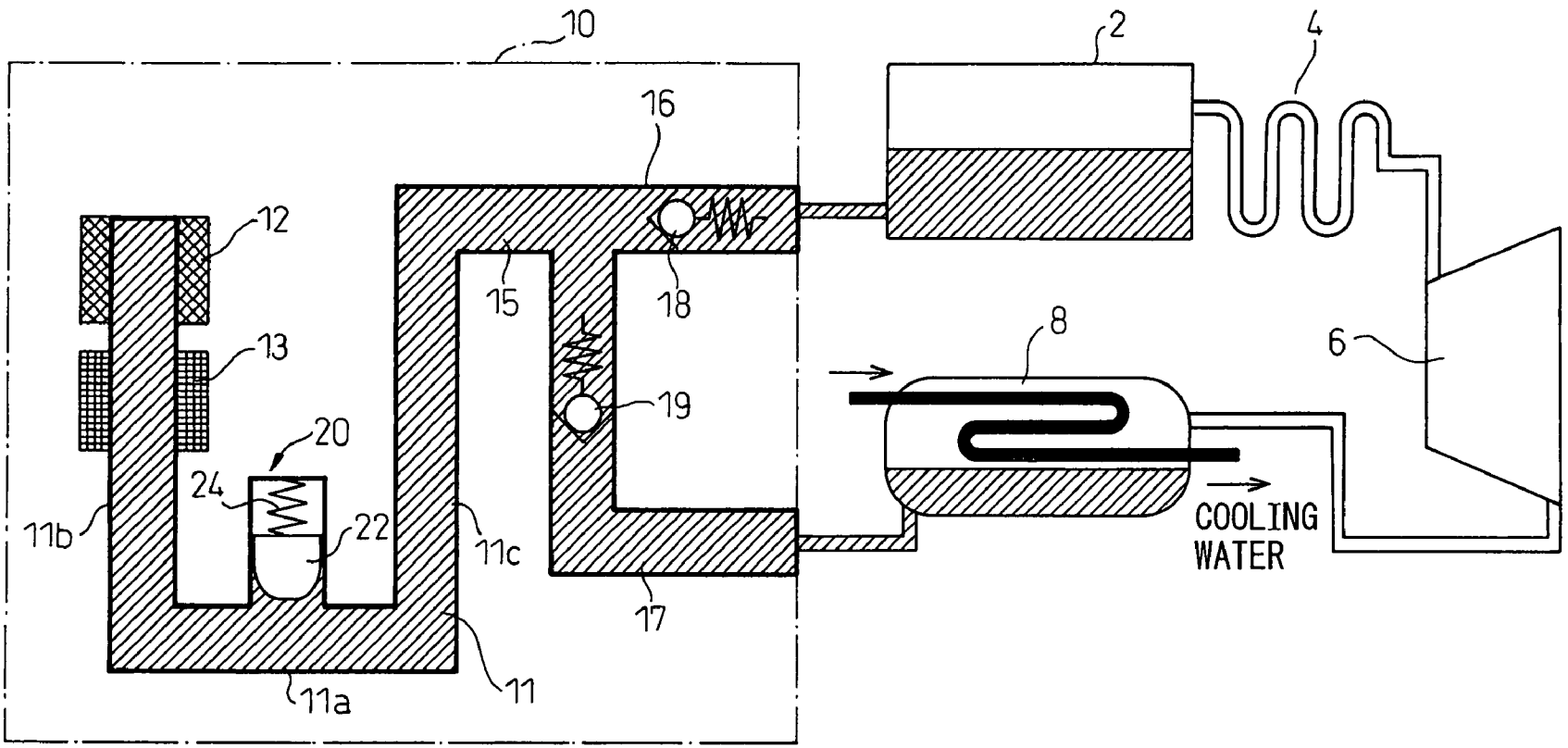
FIG. 1 is a schematic view of the configuration showing the overall configuration of a Rankine cycle system of a first embodiment.

FIG. 1 is an explanatory view showing the overall configuration of a Rankine cycle system of a first embodiment to which the present invention is applied.

As shown in FIG. 1, the Rankine cycle system of the present invention is comprised of a boiler 2 heating a working fluid comprised of water to generate steam, a superheater 4 superheating the steam generated at the boiler 2 to generate high pressure steam, a turbine 6 driven by the high pressure steam generated by the superheater 4, a steam condenser 8 cooling and liquefying, by cooling water, the steam utilized for driving the turbine 6, and a water pump 10 pumping up the working fluid (that is, water) liquefied by this steam condenser 8 and feeding it to the boiler 2.

Further, for this water pump 10, not a general electrical pump used in a conventional Rankine cycle system, but a fluid pump to which the present invention is applied is used. That is, this water pump 10 is provided with a fluid vessel 11 in which a working fluid the same as the working fluid of the Rankine cycle system (that is, water) is sealed in a flowable manner, a heater 12 heating the fluid in the fluid vessel 11, and a cooler 13 cooling the steam heated and vaporized at the heater 12.

The fluid vessel 11 is formed from a material excellent in heat insulation (specifically, in the present embodiment, since the working fluid is water, stainless steel) except at the locations corresponding to the heater 12 and cooler 13, while the locations corresponding to the heater 12 and cooler 13 are formed from copper or aluminum better in heat conductivity than that material (that is, stainless steel).

Further, the fluid vessel 11, for example, is comprised of a pipe made of stainless steel which is bent into a U-shape so as to form a substantially U-shaped pipe shape arranged so that the bent part 11*a* is positioned at the bottommost part and the two straight parts 11*b*, 11*c* extending from the bent part 11*a* are positioned on the verticals.

Further, among the two straight parts 11*b*, 11*c* forming the fluid vessel 11, one straight part 11*b* is provided with the heater 12 and cooler 13. Further, this straight part 11*b* is closed at its top end. The heater 12 is arranged around the top end of this straight part 11*b*, while the cooler 13 is arranged around the straight part 11*b* below the heater 12.

On the other hand, the top end of the other straight part 11*c* forming the fluid vessel 11 extends in the substantially horizontal direction as the pipe 15. The other end of this pipe 15 is connected to a discharge side fluid passage 16 for discharging the water in the fluid vessel 11 to the boiler 2 and a suction side fluid passage 17 for sucking water in from the steam condenser 8.

Further, the discharge side fluid passage 16 is provided in it with a discharge side one-way valve 18 opening when the pressure inside the fluid vessel 11 rises and discharging the inside water to the boiler 2, while the suction side fluid passage 17 is provided inside it with a suction side one-way valve 19 opening when the pressure inside the fluid vessel 11 falls and sucking water in the steam condenser 8 into the fluid vessel 11.

Further, the bent part 11*a* positioned at the bottommost part of the fluid vessel 11 is provided with a vibrator 20 storing part of the energy when the pressure in the fluid vessel 11 rises and using the stored energy to raise the pressure in the fluid vessel 11 when the pressure in the fluid vessel 11 next falls so as to thereby send fluid to the heater 12.

This vibrator 20 corresponds to the energy storing means of the present invention and is comprised of a cylinder communicating with the bent part 11*a* of the fluid vessel 11 in which a piston 22 can slide and a partition comprised of the piston 22 and a spring 24 biasing this piston 22 to the fluid vessel 11 side accommodated in the same.

Figure 2A:
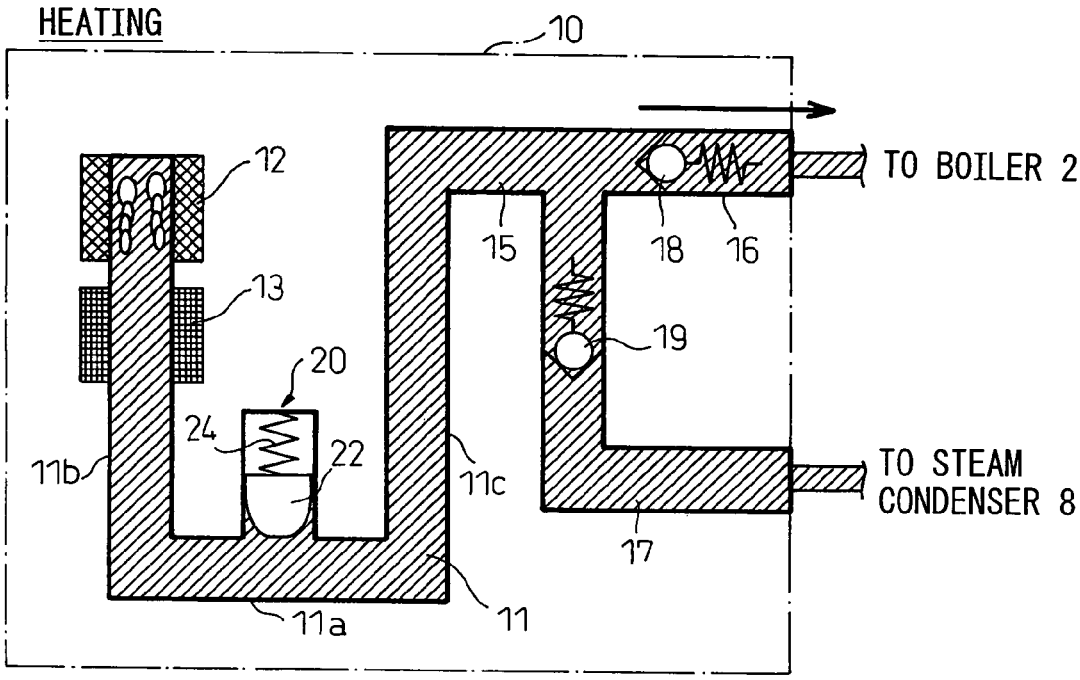
FIGS. 2A to 2D are explanatory views for explaining the operation of a water pump (fluid pump) of the first embodiment.

Next, the operation of the water pump 10 of the present embodiment will be explained using FIGS. 2A to 2D. As shown in FIG. 2A, at the water pump 10, when the heater 12 and cooler 13 are operated, the upper liquid (water) in the straight part 11*b* of the fluid vessel 11 is heated and vaporized by the heater 12 whereby the pressure in the fluid vessel 11 starts to rise. As a result, the liquid sealed in the fluid vessel 11 starts to flow from the straight part 11*b* to the straight part 11*c*, the discharge side one-way valve 18 opens, and the water in the fluid vessel 11 starts to be discharged to the boiler 2.

Figure 2B:
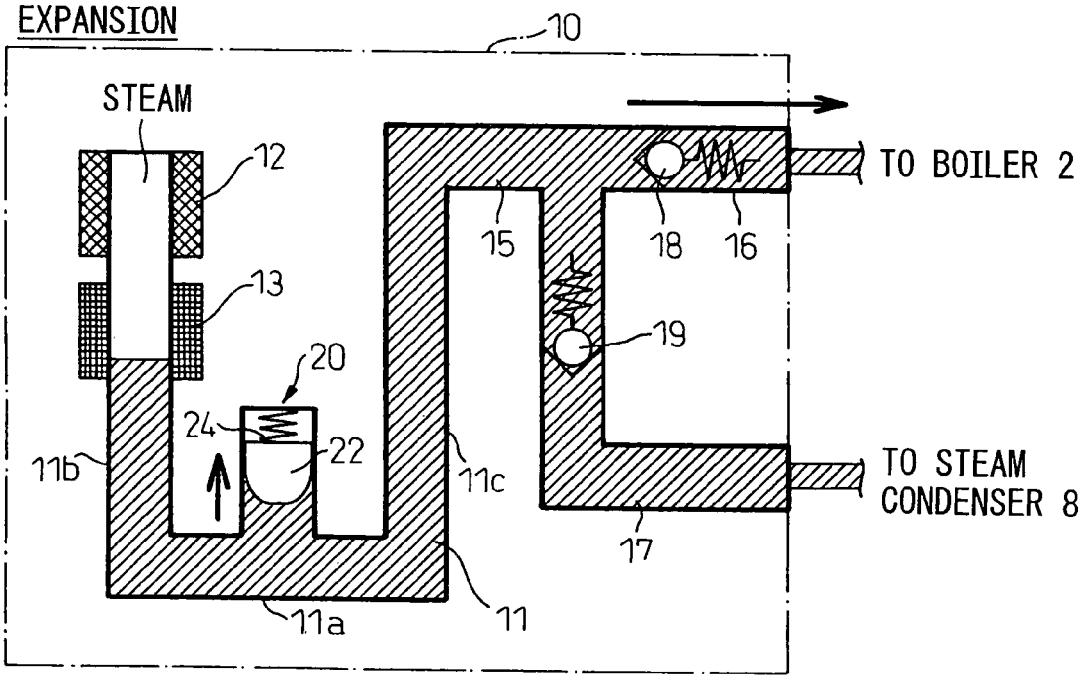

Further, along with heating by the heater 12, the steam vaporized in the straight part 11*b* of the fluid vessel 11 expands and the pressure in the fluid vessel 11 further rises. This being so, as shown in FIG. 2B, that expansion energy causes the piston 22 of the vibrator 20 to displace against the biasing force of the spring 24 to the outside of the fluid vessel 11. That energy is stored as repulsion force of the spring 24 in the vibrator 20.

Figure 2C:
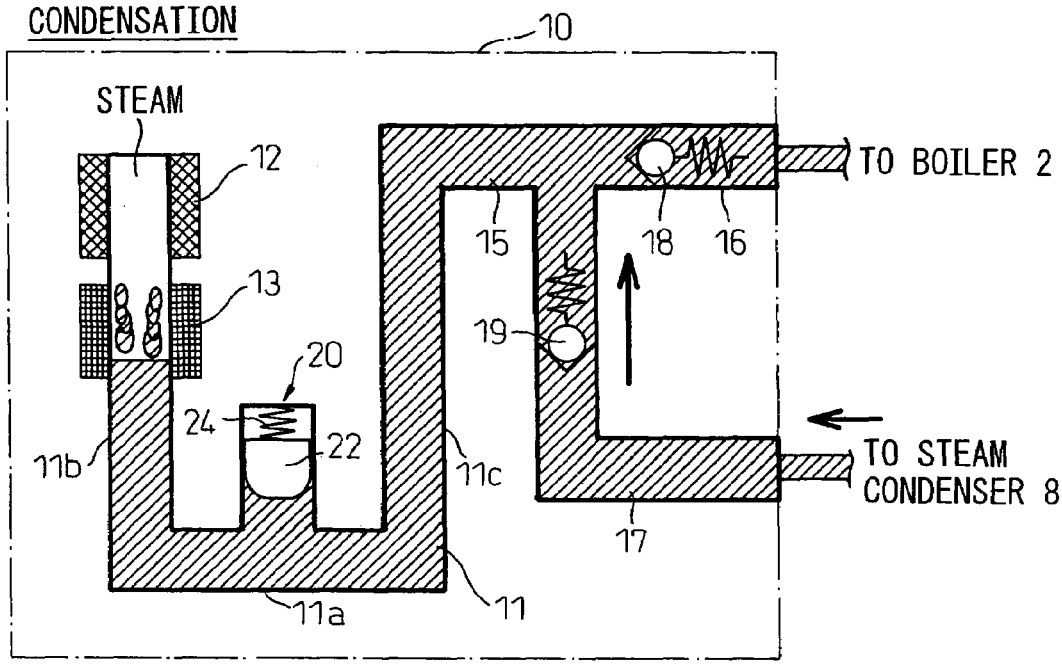

Next, when the steam generated in the straight part 11*b* of the fluid vessel 11 causes the level of the liquid to fall to the cooler 13, the steam is cooled by the cooler 13 and starts to condense. This being so, the pressure in the fluid vessel 11 starts to fall, so the discharge side one-way valve 18 closes, then the suction side one-way valve 19 opens and, as shown in FIG. 2C, liquid (water) starts to flow from the steam condenser 8 to the inside of the fluid vessel 11.

Figure 2D:
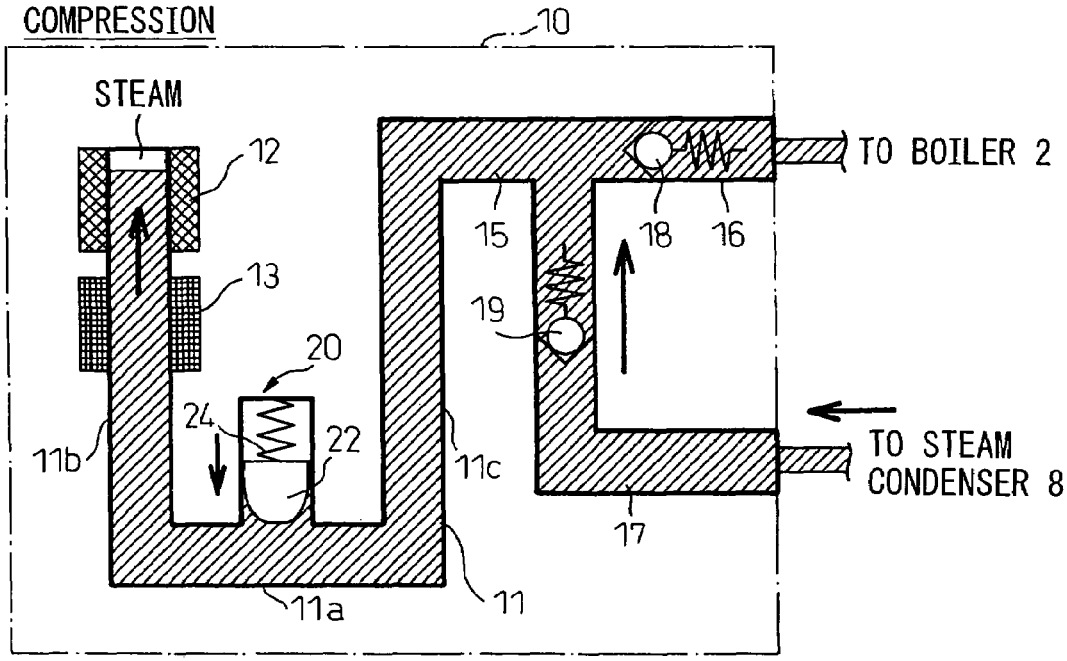

Further, when the cooling by the cooler 13 causes the steam to further liquefy and the pressure in the fluid vessel 11 further falls, not only is the working fluid (water) of the Rankine cycle system liquefied at the steam condenser 8 sucked into the fluid vessel 11, but also, as shown FIG. 2D, the energy stored in the spring 24 of the vibrator 20 causes the piston 22 to move to the fluid vessel 11 side. Along with this, the steam in the fluid vessel 11 is compressed and the liquid (water) flows into the heating space formed by the heater 12.

Further, the liquid (water) flowing into the heating space of the heater 12 in this way is again vaporized by the heater 12, then the steps of heating-expansion-condensation-compression shown in FIGS. 2A to 2D are repeated.

In this way, according to the Rankine cycle system of the present invention, as the pump for circulating the working fluid comprised of the water, not a conventionally used electrical pump, but a water pump 10 using the fluid pump of the present invention is used.

Further, according to this water pump 10, by just heating and cooling the fluid in the fluid vessel 11, the working fluid liquefied at the steam condenser 8 can be sucked in and fed to the boiler 2. For this operation, it is not necessary to supply electrical energy from the outside, so the Rankine cycle system can be streamlined in configuration and the production costs can be reduced.

Further, to operate the water pump 10 of the present embodiment, the fluid in the fluid vessel has to be heated and cooled, but in a Rankine cycle system, the heat used for heating the fluid in the boiler 2 or superheater 4 is discarded as waste heat, so if utilizing this heat for operating the water pump 10, the running costs required for operating the water pump 10 can be reduced to substantially zero.

Further, in the water pump 10 of the present embodiment, the bent part 11*a* of the fluid vessel 11 formed by the fluid passage from the cooler 13 to the discharge side and suction side one-way valves 18, 19 is provided with an energy storing means comprised of a vibrator 20. Further, this vibrator 20 stores part of the expansion energy of the steam vaporized at the heater 12 and uses the stored energy to send working fluid into the heater 12 when the cooling (condensation) of the steam causes the pressure inside the fluid vessel 11 to drop, so the heating operation of the fluid by the heater 12 can be quickly started and operating efficiency of the water pump 10 can be raised.

Note that when the condensation of the steam causes the pressure in the fluid vessel 11 to drop in this way, the operation of the vibrator 20 enables the fluid (water) to be quickly fed to the heater 12, whereupon the heater 12 starts to heat the fluid (water), so steam always remains in the heating space formed by the heater 12 due to the heat from the heater 12 (see FIG. 2D).

For this reason, according to the present embodiment, it is possible to prevent the gas able to ease the rise in the pressure in the fluid vessel 11 from running out at the time of operation of the water pump 10, the pressure in the fluid vessel 11 from rising too much, and the movement (vibration) of the working fluid (water) in the fluid vessel 11 from stopping.

Figure 3:
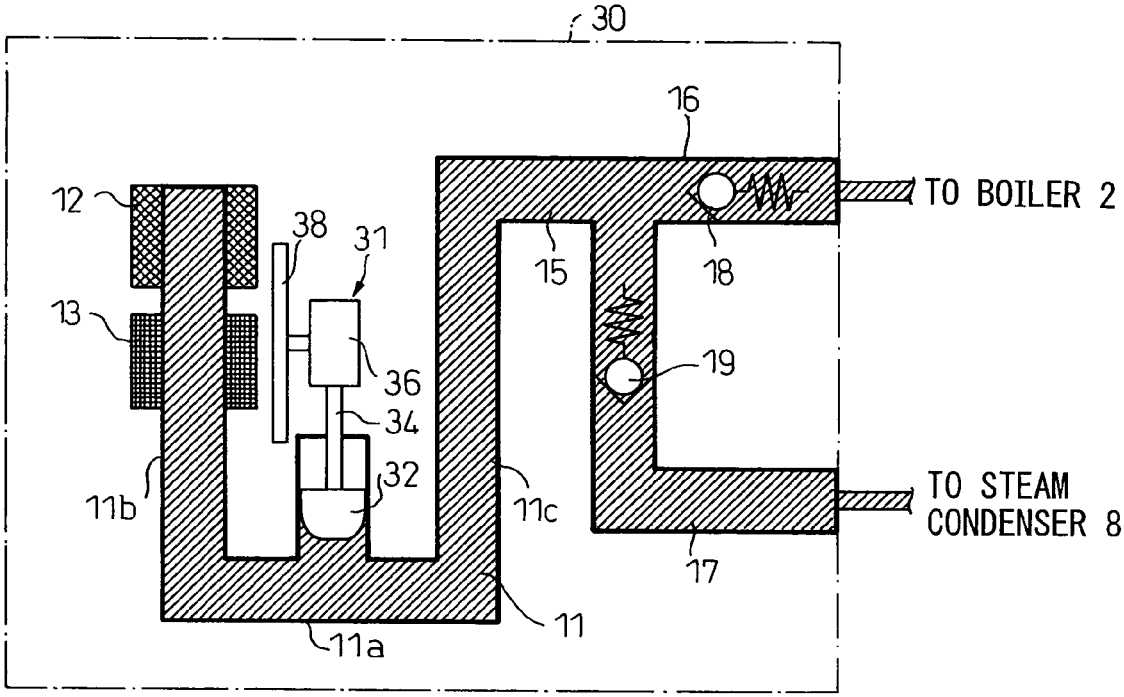
FIG. 3 is an explanatory view for explaining a modification of the water pump of the first embodiment.

Here, in the first embodiment, the energy storing means comprised of the vibrator 20 was explained as being comprised of the piston 22 and spring 24, but for example, like with the water pump 30 shown in FIG. 3, it is also possible to configure an energy storing means comprised of the vibrator 31 by connecting a rod 34 to a piston 32 provided in a cylinder communicated with the bent part 11*a* of the fluid vessel 11, providing at the other end of this rod 34 a conversion mechanism (more specifically, a crank etc.) 36 for converting movement of the rod 34 in the axial direction to rotary motion, and providing the shaft of this conversion mechanism 36 with a flywheel 38.

That is, according to this, the flywheel 38 rotates in synchronization with pressure fluctuations of the working fluid (water) in the fluid vessel 11. At the time of low pressure, the rotation of this flywheel 38 causes the piston 32 to move to the fluid vessel 11 side and enables the heater 12 to be fed with working fluid (water).

Figure 4A:
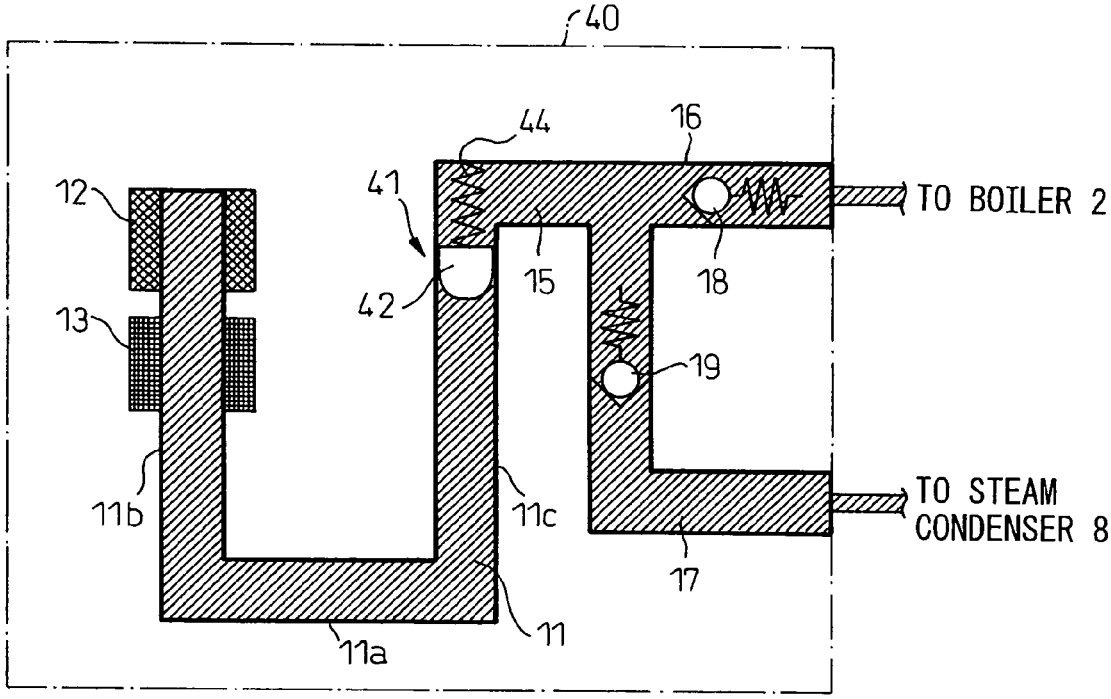
FIGS. 4A to 4C are explanatory views for explaining another modification of the water pump of the first embodiment.

Further, as such a vibrator, for example, it is possible to fill the cylinder in which the piston 22 or 32 is slidably housed with a gas and utilize that gas as a gas spring. Further, the energy storing means comprised of the vibrator does not necessarily have to use a piston (or bellows, diaphragm, or other partition) provided in a cylinder communicated with the fluid vessel 11. For example, like with the water pump 40 shown in FIGS. 4A to 4C, the vibrator 41 may be comprised of a piston 42 provided in the fluid vessel 11 and a spring 44 biasing this piston 42 in the heater 12 direction.

That is, even if configuring the vibrator 41 in this way, the piston 42 moves to the opposite side from the heater 12 due to the expansion energy generated in the fluid vessel 11 and that expansion energy is stored in the spring 44. The drop in fluid pressure in the fluid vessel 11 after that enables fluid to be fed to the heater 12.

Figure 4B:
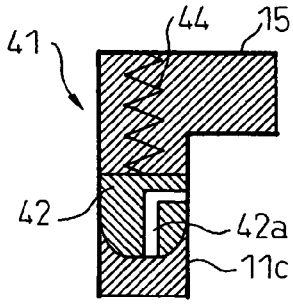
Figure 4C:
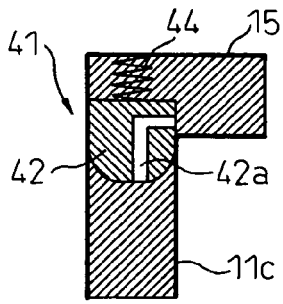

Note that when providing a piston 42 in the fluid vessel 11 in this way, as shown in FIGS. 4B and 4C, it is necessary to form the piston 42 with a passage 42*a* for movement of the working fluid and feed the discharge side fluid passage 15 with liquid (water) present at the pressurizer 12 side of the piston 42 and enable that liquid (water) to be discharged toward the boiler 2 when the expansion energy generated at the heater 12 side causes the piston 42 to move in the direction storing energy (see FIG. 4B).

Second Embodiment

Figure 5A:
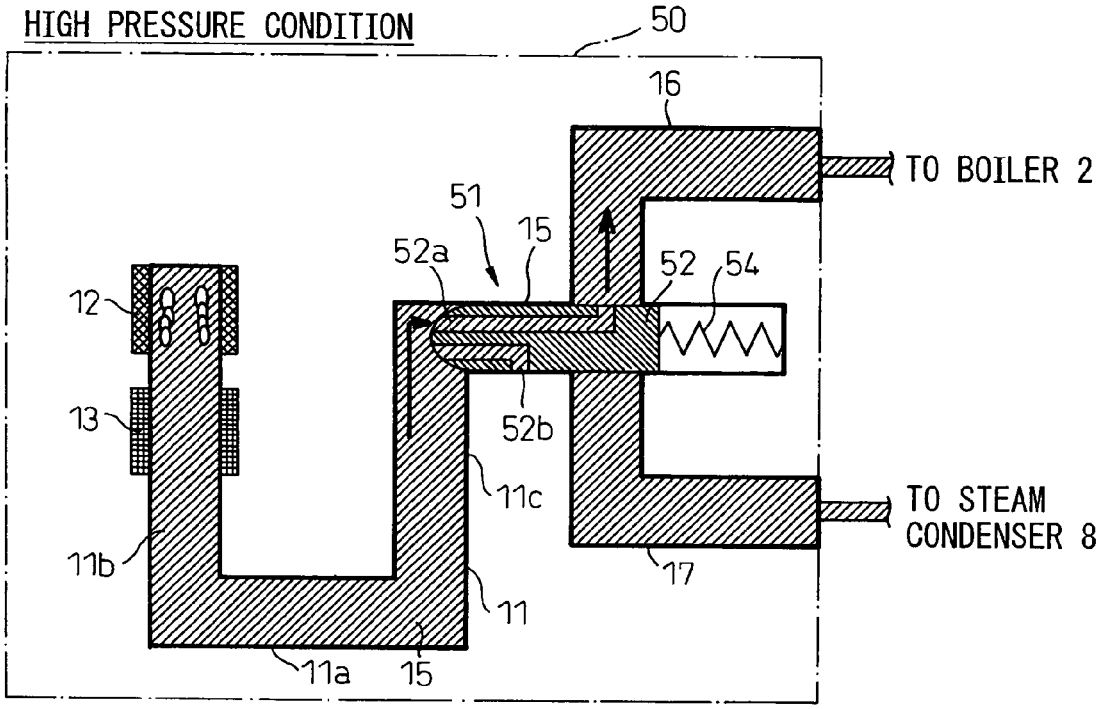
FIGS. 5A and 5B are explanatory views of the configuration and operation of a water pump of a second embodiment.
Figure 5B:
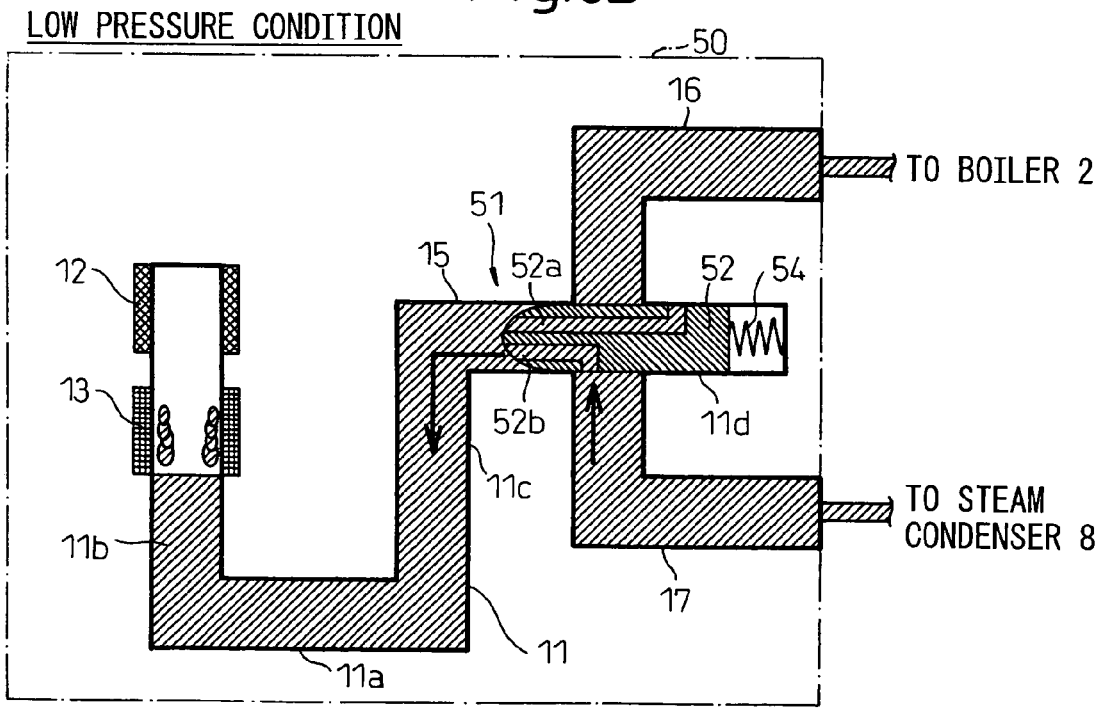

Next, FIGS. 5A and 5B are explanatory views showing a water pump 50 for a Rankine cycle system of a second embodiment to which the present invention is applied.

As shown in FIGS. 5A and 5B, the water pump 50 of the present embodiment, like the first embodiment, is provided with a fluid vessel 11 comprised of a pipe made of stainless steel bent into a U-shape to form a substantially U-shaped pipe shape fluid vessel 11. Further, this fluid vessel 11 is arranged so that its bent part 11*a* is positioned at the bottom-most part and the two straight parts 11*b*, 11*c* extending from the bent part 11*a* are positioned on the verticals. Further, one straight part 11*b*, like in the first embodiment, is provided with the heater 12 and cooler 13.

On the other hand, the top end of the other straight part 11*c* forming the fluid vessel 11 extends straight in the substantially horizontal direction to form a pipe 15. In the middle of this pipe 15, a discharge side fluid passage 16 for discharging water in the fluid vessel 11 to the boiler 2 and a suction side fluid passage 17 for sucking in water from the steam condenser 8 are connected to be substantially perpendicular with the pipe 15. Further, the pipe 15 is provided with, as the vibrator 51, a long piston 52 so as to block the connection part to the fluid passages 16, 17.

Further, the pipe 15 is closed at the front end part. Between this closed end and the piston 52, a spring 54 for biasing the piston 52 to the fluid vessel 11 side is stored. Further, this piston 52 is provided with a first passage 52*a* communicating the fluid vessel 11 and discharge side fluid passage 16 when the biasing force of the spring 54 causes the piston 52 to be positioned at the fluid vessel 11 side and a second passage 52*b* communicating the fluid vessel 11 and the suction side fluid passage 17 and when the piston 52 is positioned at the terminating side of the pipe 15 (that is, the side opposite to the fluid vessel 11).

Note that the distance between the opening of the first passage 52*a* to the discharge side fluid passage 16 and the opening of the second passage 52*b* to the suction side fluid passage 17 along the sliding direction of the piston 52 is set to a value of at least the pipe diameter of the fluid passages 16, 17 so that the passages 52*a*, 52*b* do not simultaneously communicate with the corresponding fluid passages 16, 17.

For this reason, according to the water pump 50 of the second embodiment, as shown in FIG. 5A, at the time of high pressure where the heater 12 is used to heat and vaporize the fluid (water) in the fluid vessel 11 and form steam, the liquid (water) in the fluid vessel 11 passes through the first passage 52*a* to flow out to the discharge side fluid passage 16 and is supplied to the boiler 2.

Further, due to the expansion of the steam, when the piston 52 receives its expansion energy and moves to the terminating side of the pipe 15, the first passage 52*a* is shut and the fluid vessel 11 is communicated through the second passage 52*b* to the suction side fluid passage 17.

For this reason, as shown in FIG. 5B, when the steam expands and is condensed by the cooling by the cooler 13 (that is, at the time of low pressure of the fluid vessel 11), the liquid flows from the steam condenser 8 through the suction side fluid passage 17 and second passage 52*b* to the fluid vessel 11.

Further, if the fluid vessel 11 falls in pressure and the energy stored in the spring 54 causes the piston 52 to move to the fluid vessel 11 side, the liquid (water) in the fluid vessel 11 is supplied to the heater 12 due to the movement and the liquid (water) is again heated by the heater 12.

Accordingly, according to the water pump 50 of the present embodiment, it is possible to realize substantially the same functions as the first embodiment without providing one-way valves at the discharge side fluid passage 16 and the suction side fluid passage 17 like in the first embodiment.

Third Embodiment

Figure 6:
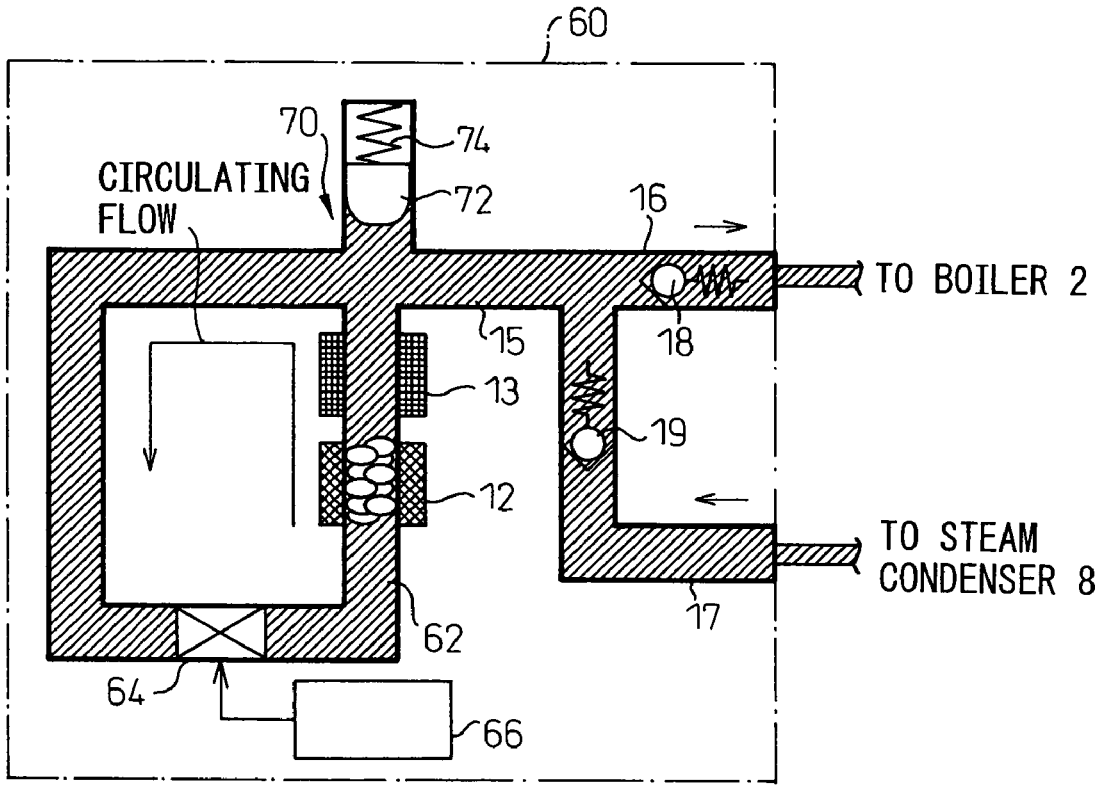
FIG. 6 is explanatory view of the configuration and operation of a water pump of a third embodiment.

Next, FIG. 6 is an explanatory view showing a water pump 60 for a Rankine cycle system of a third embodiment to which the present invention is applied.

As shown in FIG. 6, the water pump 60 of the present embodiment is provided with a ring-shaped fluid vessel 62. Further, in this fluid vessel 62, a straight part along the vertical direction is provided with the heater 12 and cooler 13 so that the cooler 13 is positioned above the heater 12.

Note that the fluid vessel 62 is formed from a material excellent in heat insulation (specifically stainless steel) except at the locations corresponding to the heater 12 and cooler 13, while the locations corresponding to the heater 12 and cooler 13 are formed from copper or aluminum better in heat conductivity than that material (that is, stainless steel).

In the fluid vessel 62, the part above the cooler 13 is extended in the substantially horizontal direction as the pipe 15. The other end of this pipe 15, like with the water pump 10 of the first embodiment, is connected to a discharge side fluid passage 16 for discharging water in the fluid vessel 21 to the boiler 2 and a suction side fluid passage 17 for sucking in water from the steam condenser 8. Further, the discharge side fluid passage 16 is provided inside it with a discharge side one-way valve 18, while the suction side fluid passage 17 is provided with a suction side one-way valve 19.

On the other hand, in the fluid vessel 62, below the heater 12, a shut-off valve 64 is provided for opening and closing the passage of the fluid. This shut-off valve 64 is cyclically opened and closed by the drive circuit 66.

Further, near the fluid vessel 62 of the pipe 15 communicating the ring-shaped fluid vessel 62 and the fluid passages 16, 17, in the same way as the vibrator 20 of the first embodiment, a vibrator 70 comprised of a cylinder communicated with the fluid vessel 62 and in which a piston 72 can slide and a partition comprised of a piston 72 and a spring 74 biasing this piston 72 to the fluid vessel 62 side housed in the same is provided.

In the thus configured water pump 60 of the present embodiment, when closing the shut-off valve 64, the movement of fluid in the fluid vessel 62 is stopped, so the fluid inside the heater 12 is sufficiently heated to boil and vaporize and the vaporized steam expands.

This being so, this expansion pressure causes the discharge side one-way valve 18 to open and discharge water in the fluid vessel 21 to the boiler 2 side. Further, this expansion pressure is also applied to the piston 72 of the vibrator 70, so the piston 72 moves by the expansion pressure in a direction pushing against the spring 74. The spring 74 stores that energy.

Further, the thus expanded steam rises from the heater 12 to the cooler 13 side above it, but the drive circuit 66 is designed to temporarily open the shut-off valve 64 in synchronization with the rising operation of the steam after closing of the shut-off valve 64. For this reason, the steam generated and expanded by heating by the heater 12 quickly moves from the heater 12 to the cooler 13 and is cooled and liquefied at the cooler 13.

Further, at this time, the fluid vessel 62 side of the suction side one-way valve 19 is subjected to a negative pressure for suction of the fluid in the fluid vessel 62, so the suction side one-way valve 19 opens and working fluid flows from the steam condenser 8 to inside the fluid vessel 62. Further, the piston 72 of the vibrator 70 also displaces to the fluid vessel 62 side due to the energy stored in the spring 74, so the working fluid sucked in from the steam condenser 8 passes through the circulation path of the fluid vessel 62 and is supplied to the heater 12 side.

Therefore, in the water pump 60 of the present embodiment as well, in the same way as the water pump 10 of the first embodiment, it becomes possible to cyclically make the fluid in the fluid vessel 62 flow and automatically pump up the working fluid of the Rankine cycle system liquefied at the steam condenser 8 and feed it to the boiler 2.

Further, the water pump 60 of the present embodiment requires provision of a drive circuit 66 for driving the shut-off valve 64, but the drive circuit 66 may simply cyclically operate the shut-off valve 64 and therefore be configured much more simply than the drive circuit for driving an electrical pump, so the Rankine cycle system can be streamlined in configuration and its production costs can be reduced. Further, for the heating of the fluid in the fluid vessel 62, the heat generated by the Rankine cycle system can be utilized, so the running costs required for operating the water pump 60 can be sufficiently reduced.

Fourth Embodiment

Figure 7A:
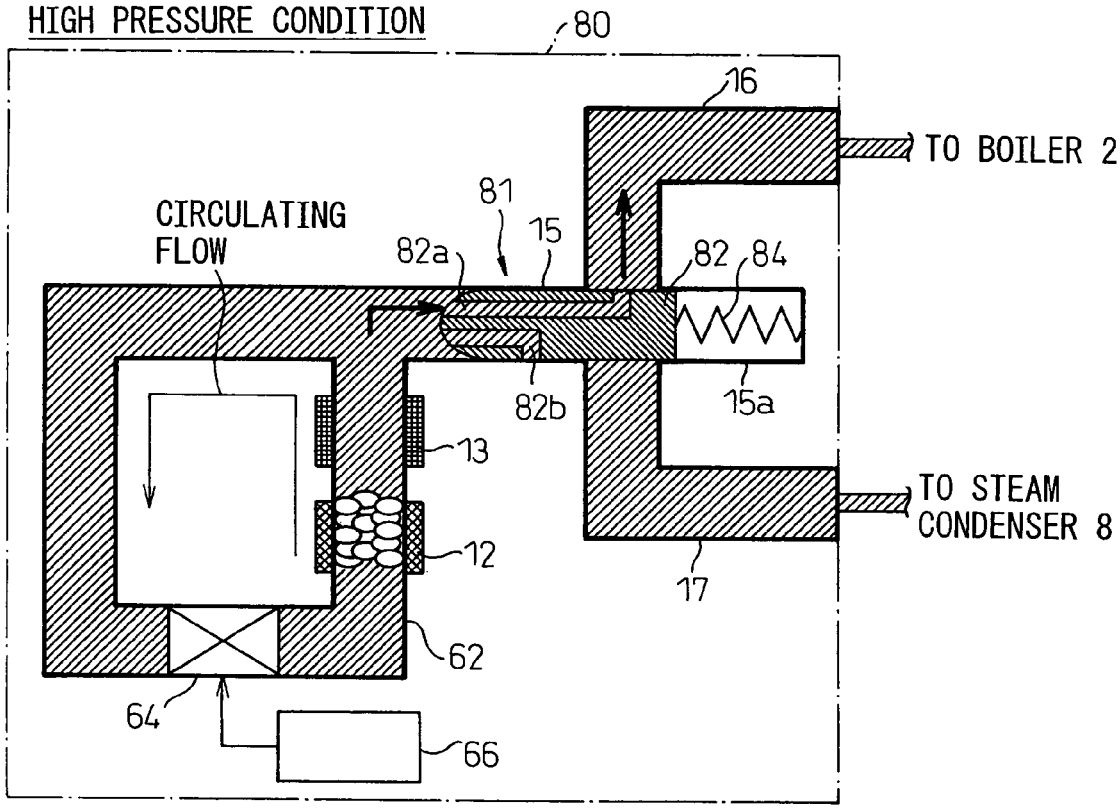
FIGS. 7A and 7B are explanatory views of the configuration and operation of a water pump of a fourth embodiment.
Figure 7B:
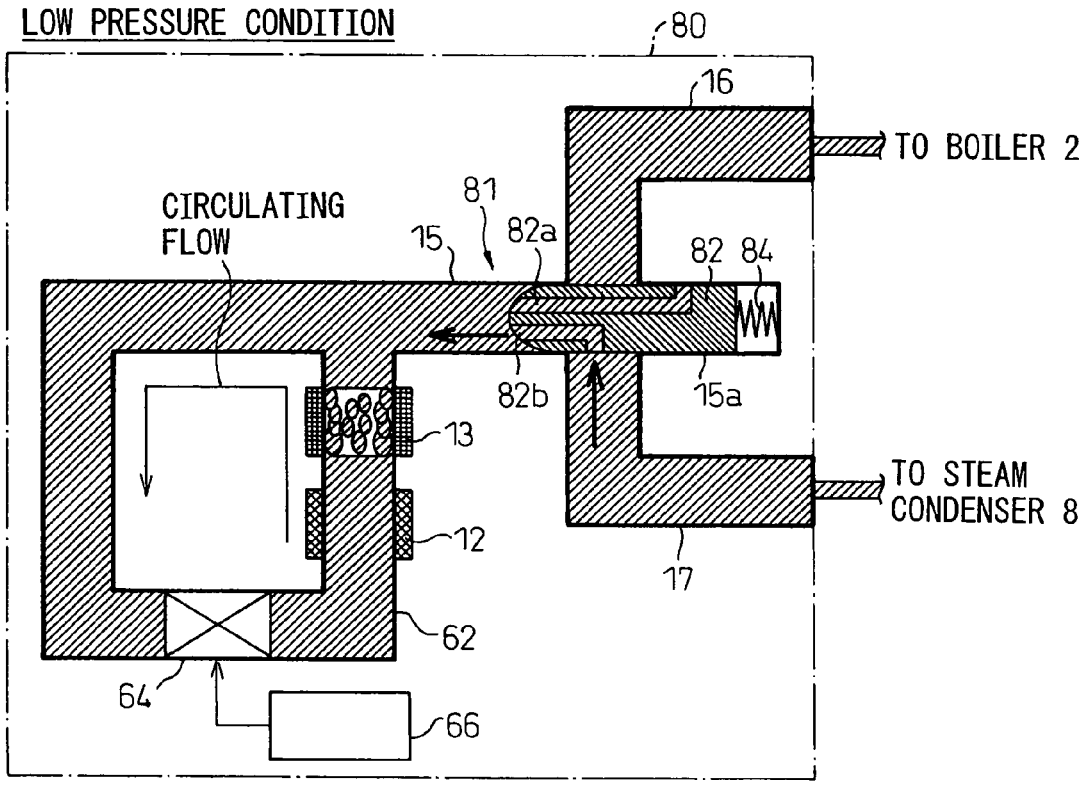

Next, FIGS. 7A and 7B are explanatory views showing a water pump 80 for a Rankine cycle system of a fourth embodiment to which the present invention is applied.

As shown in FIGS. 7A and 7B, the water pump 80 of the present embodiment, like the water pump 60 of the third embodiment, is provided with a ring-shaped fluid vessel 62 provided with a heater 12, cooler 13, and shut-off valve 64. Further, in this fluid vessel 62, the pipe 16 connecting the fluid vessel 62 and the discharge side and suction side fluid passages 16, 17, like in the water pump 50 of the second embodiment, extends straight from the fluid vessel 62 in the substantially horizontal direction, while the fluid passages 16, 17 are connected to the middle of this pipe 15. Further, the pipe 15 is provided with, as the vibrator 81, a long piston 82 so as to shut off the connection parts to the fluid passages 16, 17.

Further, the pipe 15 is closed at the front end part. Between this closed end and the piston 82, a spring 84 for biasing the piston 82 to the fluid vessel 62 side is stored. Further, this piston 82 is provided with a first passage 82*a* for communicating the fluid vessel 62 and discharge side fluid passage 16 when the biasing force of the spring 84 causes the piston 82 to be positioned at the fluid vessel 62 side and a second passage 82*b* for communicating the fluid vessel 62 and suction side fluid passage 17 when the piston 82 is at the terminating side of the pipe 15 (that is, the side opposite to the fluid vessel 62).

Note that the distance between the opening of the first passage 82*a* to the discharge side fluid passage 16 and the opening of the second passage 82*b* to the suction side fluid passage 17 along the sliding direction of the piston 82 is set to a value of at least the pipe diameter of the fluid passages 16, 17 so that the passages 82*a*, 82*b* do not simultaneously communicate with the corresponding fluid passages 16, 17.

For this reason, according to the water pump 80 of the fourth embodiment, as shown in FIG. 7A, at the time of high pressure where the heater 12 is used to heat and vaporize the fluid (water) in the fluid vessel 62 and form steam, the liquid (water) in the fluid vessel 62 passes through the first passage 82*a* to flow out to the discharge side fluid passage 16 and is supplied to the boiler 2.

Further, due to the expansion of the steam, when the piston 82 receives its expansion energy and moves to the terminating side of the pipe 15, the first passage 82*a* is shut and the fluid vessel 62 is communicated through the second passage 82*b* to the suction side fluid passage 17.

For this reason, as shown in FIG. 7B, when the steam expands and is condensed by the cooling by the cooler 13 (that is, at the time of low pressure of the fluid vessel 62), the liquid flows from the steam condenser 8 through the suction side fluid passage 17 and second passage 82*b* to the fluid vessel 62.

Further, if the fluid vessel 62 falls in pressure and the energy stored in the spring 84 causes the piston 82 to move to the fluid vessel 62 side, the liquid (water) in the fluid vessel 62 passes through the circulation path of the fluid vessel 62 and is supplied to the heater 12 side.

Accordingly, according to the water pump 80 of the present embodiment, in the same way as the third embodiment, it is possible to realize a water pump able to using a ring-shaped fluid vessel 62 to supply and discharge working fluid. Further, it is not necessary to provide one-way valves at the discharge side fluid passage 16 and suction side fluid passage 17 like in the third embodiment, so it is possible to realize a water pump using a ring-shaped fluid vessel 62 by a lower cost than the third embodiment.

While the invention has been described with reference to specific embodiments chosen for purpose of illustration, it should be apparent that numerous modifications could be made thereto by those skilled in the art without departing from the basic concept and scope of the invention.

The invention claimed is:

1. A fluid pump provided with:

a fluid vessel in which a fluid is sealed in a flowable manner, a heater heating and vaporizing the fluid in the fluid vessel to produce steam, a cooler arranged below said heater, the cooler cooling and liquefying steam obtained by vaporization by the heating by said heater in said fluid vessel, a discharge side fluid passage discharging liquid in said fluid vessel to the outside, a suction side fluid passage sucking liquid into a fluid vessel from the outside, a piston provided movably in a pipe connecting said fluid vessel and said discharge side fluid passage and said suction side fluid passage, means for storing part of the expansion energy received by said piston at a time of said expansion of the steam and using the stored energy to compress the steam and liquid when said steam liquefies, a first passage formed in said piston and communicating said fluid vessel and said discharge side fluid passage when said piston moves to said fluid vessel side, and a second passage formed in said piston together with said first passage and communicating said fluid vessel and said suction side fluid passage when said piston moves to the opposite side from said fluid vessel.

2. A fluid pump as set forth in claim 1, wherein said fluid vessel is formed into a substantially U-shaped pipe shape with a bent part positioned at its bottommost part, said heater and cooler are arranged in one straight pipe part of the U-shape of said fluid vessel, and the piston provided movably in the pipe connecting the other straight pipe part of the U-shape of said fluid vessel and said discharge side fluid passage and said suction side fluid passage.

3. A fluid pump provided with:

a ring-shaped fluid vessel in which a fluid is sealed in a flowable manner, a heater heating and vaporizing the fluid in said fluid vessel to produce steam, a cooler arranged above said heater, the cooler cooling and liquefying the steam obtained by vaporization by the heating of said heater in said fluid vessel, a discharge side fluid passage discharging liquid in said fluid vessel to the outside, a suction side fluid passage sucking liquid into said fluid vessel from the outside, a piston provided movably in a pipe connecting said fluid vessel and said discharge side fluid passage and said suction side fluid passage, means for storing part of the expansion energy received by said piston at a time of expansion of the steam and using the stored energy to compress the steam and liquid when said steam liquefies, a first passage formed in said piston and communicating said fluid vessel and said discharge side fluid passage when said piston moves to said fluid vessel side, and a second passage formed in said piston together with said first passage and communicating said fluid vessel and said suction side fluid passage when said piston moves to the opposite side from said fluid vessel.

* * * * *